US005816777A

United States Patent [19]

Hall

[11] Patent Number: 5,816,777

[45] Date of Patent: Oct. 6, 1998

[54] TURBINE BLADE COOLING

[75] Inventor: Kenneth B. Hall, Jupiter, Fla.

[73] Assignee: United Technologies Corporation, Hartford, Conn.

[21] Appl. No.: 799,650

[22] Filed: Nov. 29, 1991

[51] Int. Cl.[6] ..... F01D 5/18

[52] U.S. Cl. ..... 416/97 R

[58] Field of Search ..... 416/96 R, 96 A, 416/97 R

[56] References Cited

U.S. PATENT DOCUMENTS

| | | | |
|---|---|---|---|
| 4,257,737 | 3/1981 | Andress et al. | 416/97 R |
| 4,753,575 | 6/1988 | Levengood et al | 416/97 R |
| 4,820,122 | 4/1989 | Hall et al. | 416/97 R |
| 4,820,123 | 4/1989 | Hal | 416/97 R |
| 5,223,320 | 6/1993 | Richardson | 428/137 |
| 5,241,827 | 9/1993 | Lampes | 60/754 |
| 5,259,182 | 11/1993 | Iwai et al. | 60/39.06 |
| 5,279,127 | 1/1994 | Napoli | 60/754 |

FOREIGN PATENT DOCUMENTS

| | | | |
|---|---|---|---|
| 197402 | 11/1983 | Japan | 416/97 R |
| 364747 | 3/1973 | U.S.S.R. | 416/97 R |

*Primary Examiner*—Michael J. Carone
*Assistant Examiner*—Christopher K. Montgomery
*Attorney, Agent, or Firm*—Norman Friedland

[57] ABSTRACT

Internal heat transfer of air cooled turbine blades of a gas turbine engine is enhanced by orienting the impingement holes that interconnect the air-cooled feed passage to the hybrid passageway internally of the blade in a more radial direction to minimize pressure drop losses. By improved mixing of the cooling air in the hybrid passageway the additional mechanical turbulence promoters can be utilized without sacrificing pressure losses.

4 Claims, 4 Drawing Sheets

TURBINE BLADE COOLING

DESCRIPTION

1. Technical Field

This invention relates to air cooled turbine blades for a gas turbine engine and particularly to means for improving internal convection heat transfer coefficients in the blade's internal passages.

2. Background Art

A new type of cooling technique has been conceived and is currently undergoing development that employs a hybrid-type blade passage that feeds the film cooling holes for laying a blanket of cooling air along the outer surface of the blade. Typically, the hybrid-type passage extends from the root of the blade to the tip and flows air the full extent of the passage so that a portion of air is discharged at the tip. A cooling air feed passage, also extending from the root to the tip of the blade resupplies cooling air to the hybrid-type passage throughout its radial extent.

Hybrid cooling technology utilizes the difference between internal and external fluid pressure rise to generate high internal convective heat transfer coefficients. Internal pressure rises to generate high internal convective heat transfer coefficients. Internal pressure rises as radius increases as the result of forced vortex pumping of the cooling air due to rotation. Total pressure rise in the engine's gas path relative to the blade is primarily due to the increase of blade tangential velocity with radius, and is less than the internal coolant pressure rise without friction. Frictional losses are generated internally through use of turbulence promoters that reduce internal pressure rise to match external pressure rise. The Reynold's analogy relating frictional losses to convective heat transfer coefficients dictates that the higher the frictional pressure drop, the higher the heat transfer coefficient, all else being equal.

I have found that in a typical hybrid passage substantial losses in total pressure can be associated with mixing of resupply cooling air from the internal plenum with radial flow air in the hybrid passage. Since the total pressure drop available for generation of convection is fixed for a given application, use of a portion of the available pressure drop in mixing reduces the amount remaining for frictional losses. Therefore, given that mixing of two streams is not an efficient means of generating convection, overall heat transfer is reduced.

By virtue of this invention, improved convection by minimizing pressure loss due to mixing is realized, which maximizes the pressure drop available for friction. It is well known that total pressure loss incurred by mixing of two fluid streams is a function of the angle between the two stream. In current designs, resupply holes are essentially orifices, with the hole diameters approximately equal to wall thickness. Resupply air is injected into the hybrid passage mainstream perpendicular to the mainstream flow direction, and total pressure loss due to mixing is high. By providing sufficient wall thickness locally, to allow the resupply air to be directed more radial, mixing loss is reduced. For minimum weight, the extra wall thickness need not be continuous, but can be local protrusions on the inner wall.

SUMMARY OF THE INVENTION

An object of this invention is to provide improved internal cooling for turbine blades of a gas turbine engine.

A feature of this invention is to provide means to enhance heat transfer coefficients of the cooling fluid by orienting the resupply feed hole for the hybrid passage to inject the fluid radially so as to minimize pressure losses in the mixing process.

A still further feature of this invention is to increase the thickness of the wall of the hybrid passage to permit orientation of the drilled passage for directing the coolant radially rather than perpendicular to the flow in the hybrid passage. The thickness of the wall relative to the feed holes can be locally increased instead of having a uniform wall thickness.

The foregoing and other features and advantages of the present invention will become more apparent from the following description and accompanying drawings.

BEST MODE FOR CARRYING OUT THE INVENTION

A typical construction of a gas turbine blade is disclosed in U.S. Pat. No. 4,257,737 entitled "Cooled Rotor Blade" granted to D. E. Andress et al on Mar. 24, 1981 and assigned to the same assignee as the present patent application. As one skilled in this art will appreciate, the cooling passages are of the well-known serpentine passages that lead air from the root toward the tip making several passages in this direction. The passages adjacent the leading edge in this construction are a plurality of longitudinally extending sub-chambers. Each sub-chamber is individually fed cooled air from the adjacent serpentine passage.

This construction differs significantly from the construction of the internal cooling of the blade presented by this patent application, but an understanding of the prior art cooling techniques lends itself to an appreciation of the present invention.

Figure 1:
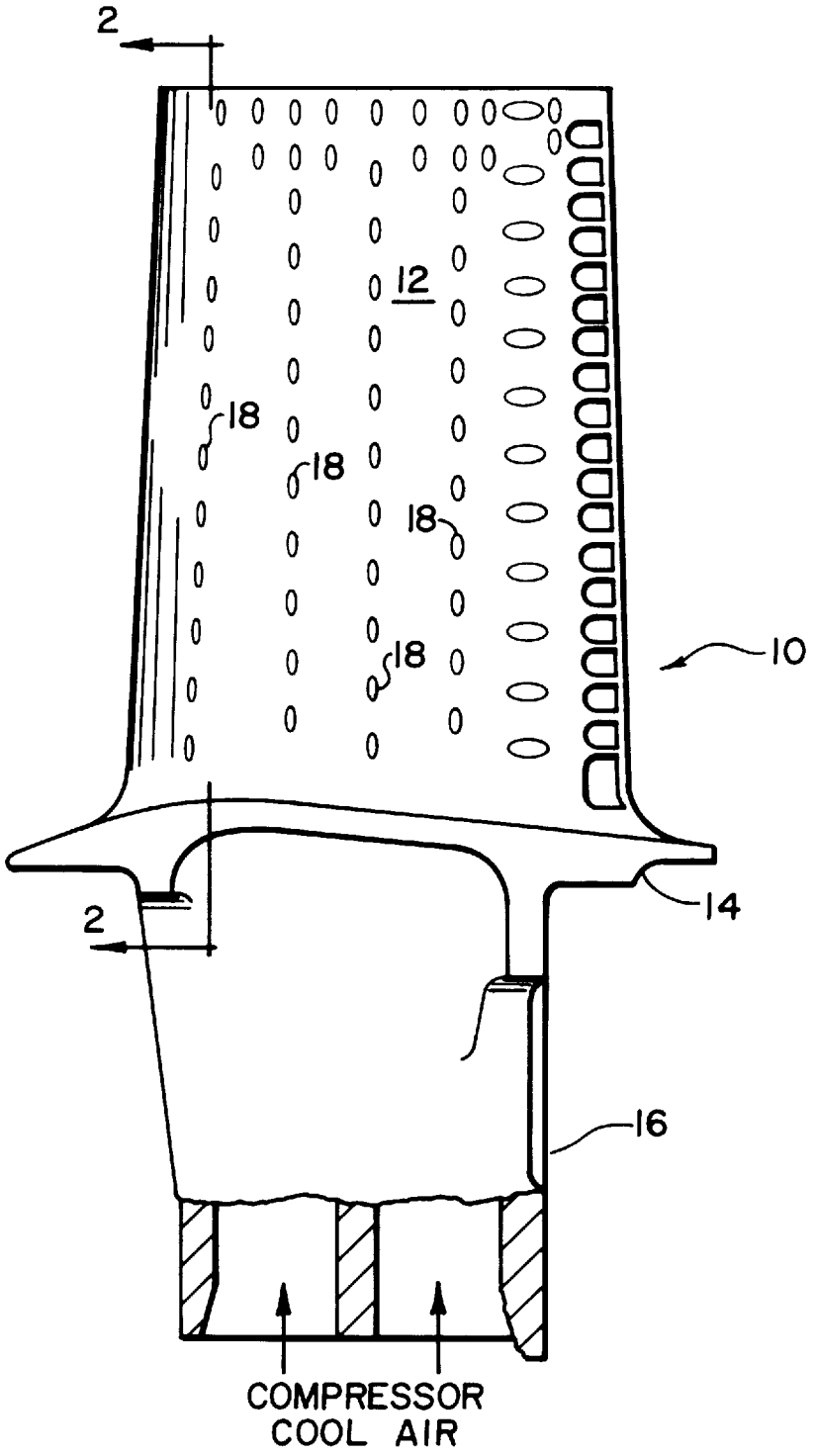
FIG. 1 is a plan view of a turbine blade.
Figure 2:
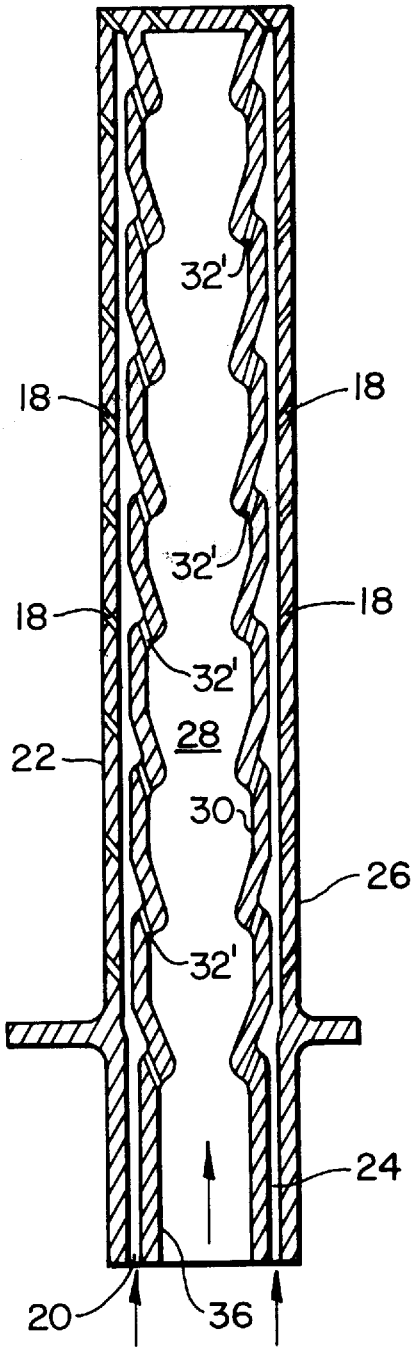
FIG. 2 is a sectional view taken along lines 2—2 of FIG. 1 illustrating the hybrid passages of the invention.
Figure 3:
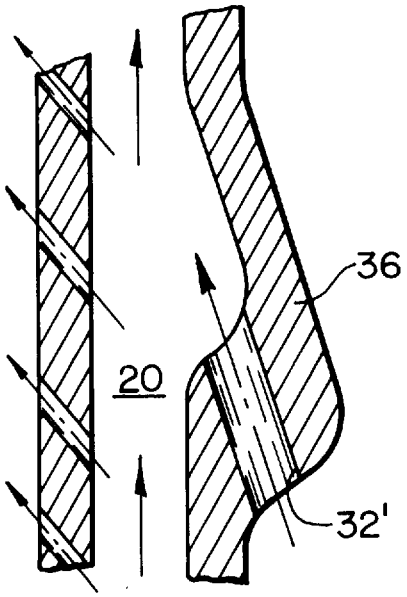
FIG. 3 is a partial view in section of the hybrid passage illustrated in FIG. 2 enlarged.

Referring to FIG. 1 through FIG. 3, the turbine blade generally illustrated by reference number 10, consists of an air foil section 12, platform 14 and root section 16 adapted to be connected to a disk in any well known manner. As is typical with internally cooled turbine blades, they are cooled by admitting air through the root section, flowing it through internal passages and discharging the air through film cooling holes 18 which are adapted to lay a sheath of film over the surface of the airfoil.

Figure 4:
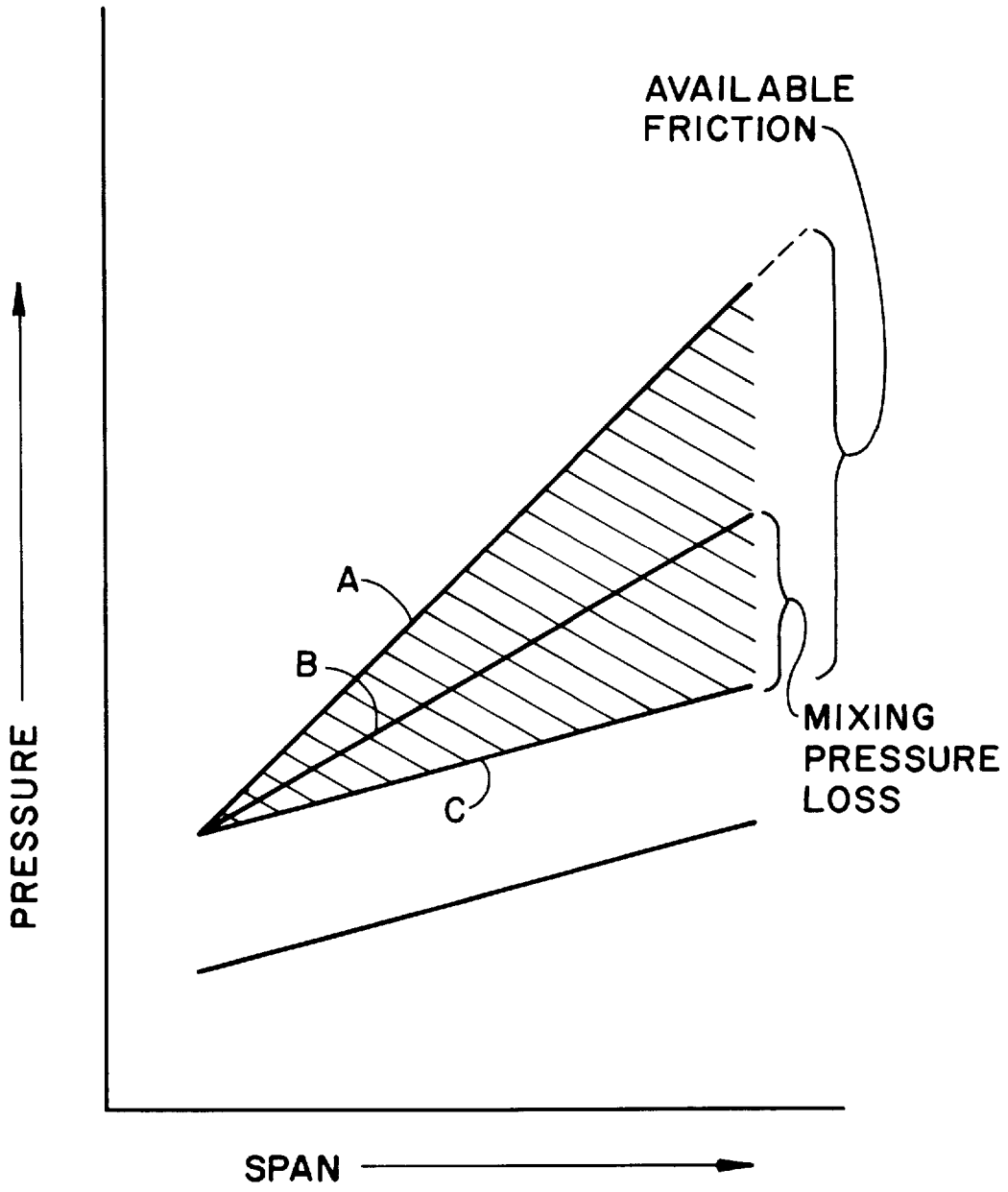
FIG. 4 is a graph plotting the pressure of the fluid in the hybrid passage versus the span of the passage.

In the typical hybrid passage as shown in FIG. 2, which shows hybrid passage 20 adjacent the pressure sides and hybrid passage 24 adjacent the suction side 26, cool air is admitted from the root section and flows toward the tip. Owing to the centrifugal forces acting on the cooling air in the hybrid passage the pressure increases as the flow proceeds radially upwardly. This is depicted by the lines A and B in the graph in FIG. 4. Replenishment cooling air is admitted to the hybrid passages 20 and 24 from the feed supply passage 28 which likewise flows compressor discharge cooling from the root toward the tip. The feed supply passage 28 serves to replenish the cooling air in the hybrid passages which feed the film cooling holes 18 radially spaced along the surface of the blade.

Figure 5:
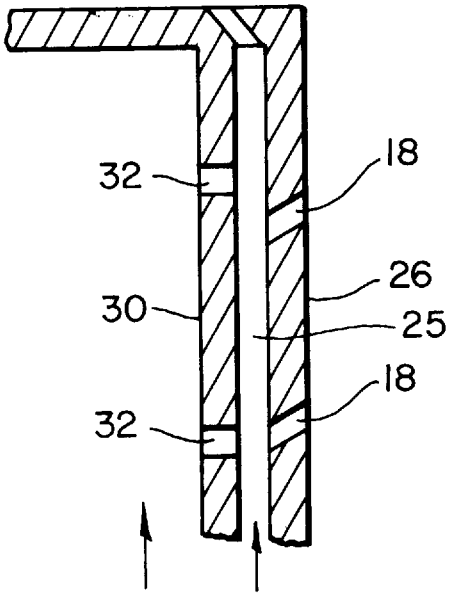
FIG. 5 (PRIOR ART)
FIG. 5 is a partial view of a hybrid passage illustrating current practices which is intended to explain the improvement of the prior art.

As depicted in FIG. 5 the wall 30 defining the hybrid passage 24 is a constant thickness and the impingement holes 32 feed the hybrid passage to replenish the cooling air but also impinges on the back surface of the airfoil skin. It will be appreciated that these holes 32 are 90 degrees relative to the flow of the cooling air in the hybrid passage 25. As mentioned earlier the impact of the mixing occasioned by this design results in a pressure loss depicted by the hatch portion of the graph in FIG. 4 extending between line B and the desired pressure rise depicted by line C. The loss of pressure due to mixing is otherwise useable as available friction which can be used for heat transfer by employing trip strips, heat transfer enhancers and the like. Ideally, it is desirable to avoid this loss so as to be able to utilize the entire available friction for heat transfer enhancement.

Figure 6:
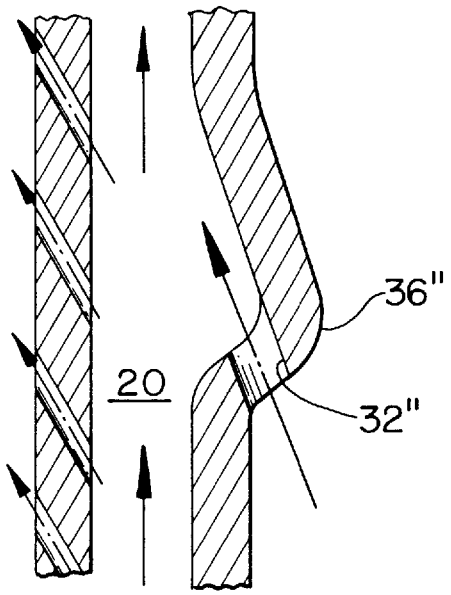
FIG. 6 is a partial view in section that is identical to the structure depicted in FIG. 3 with the wall 36" configured with a constant width dimension.

The design described above represents an earlier design of a hybrid passage. To obviate the problem and, hence, take advantage of all of the available friction, this invention contemplates reorienting the impingement holes as depicted by 32' so that they are facing a more radial direction. Referring to FIG. 3 which is an exploded partial view of the hybrid passage 20 the wall 36 is contoured so as to accommodate the impingement holes 32' in such a manner that they direct the flow from the feed supply passage 28 in a more radial direction. The wall portion adjacent the hole 32' may be thicker than the wall portion intermediate between adjacent holes 32' so as to reduce weight. Obviously, it would be in the scope of this invention to maintain a uniform wall thickness. FIG. 6 depicts the identical configuration of the structure as depicted in FIG. 3 where the wall 36" is made to have a uniform thickness and includes an impingement hole 32' which serves the same function as hole 32' depicted in FIG. 3.

What has been shown by this invention is a simple means for minimizing the pressure loss occasioned by the heretofore known mixing of the resupply air and the air in the hybrid passage. Hence, the avoidance of this loss increases the available friction which is directly useable for heat transfer enhancement and hence enhances the cooling capability of the available cooling air.

I claim:

1. An air cooled turbine blade for a gas turbine engine including a root portion, a tip portion, a leading edge, a trailing edge, a suction surface and pressure surface defining an airfoil section, internal wall means adjacent the pressure surface or the suction surface extending longitudinally of the blade from the root portion to the tip portion and defining therewith a hybrid passageway for leading cooling air from said root portion to said tip portion and through film cooling holes formed in said pressure surface or said suction surface, impingement holes formed in said internal wall means for admitting cooling air in said hybrid passageway, said impingement holes being oriented with respect to said blades rotational axis in a substantially radial direction whereby the pressure drop occasioned by the mixing of the two flows is minimized reducing frictional losses and allowing for an increase in turbulence promoters without sacrificing pressure losses.

2. An air cooled turbine blade as claimed in claim 1 wherein said wall means includes a wave-like surface having inclined portions extending in an axial direction for defining a thick section for accommodating said impingement holes.

3. An air cooled turbine blade as claimed in claim 2 wherein said wall means includes adjacent narrow portions between said thick section.

4. An air cooled turbine blade as claimed in claim 2 wherein said wall means is of uniform thickness.

* * * * *